US010943528B2

(12) United States Patent
Zhou

(10) Patent No.: US 10,943,528 B2
(45) Date of Patent: Mar. 9, 2021

(54) PIXEL CIRCUIT, METHOD OF DRIVING THE SAME AND DISPLAY USING THE SAME

(71) Applicant: EverDisplay Optronics (Shanghai) Co., Ltd., Shanghai (CN)

(72) Inventor: Xingyu Zhou, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 16/615,488

(22) PCT Filed: May 18, 2018

(86) PCT No.: PCT/CN2018/087475
§ 371 (c)(1),
(2) Date: Nov. 21, 2019

(87) PCT Pub. No.: WO2018/214818
PCT Pub. Date: Nov. 29, 2018

(65) Prior Publication Data

US 2020/0211448 A1 Jul. 2, 2020

(30) Foreign Application Priority Data

May 23, 2017 (CN) ..... 201710369943.5

(51) Int. Cl.
*G09G 3/32* (2016.01)

(52) U.S. Cl.
CPC ..... *G09G 3/32* (2013.01); *G09G 2300/043* (2013.01); *G09G 2300/0876* (2013.01); *G09G 2310/0267* (2013.01)

(58) Field of Classification Search
CPC ..... G09G 2300/043; G09G 2300/0876; G09G 2310/0267; G09G 3/32
See application file for complete search history.

(56) References Cited

U.S. PATENT DOCUMENTS 6,937,219 B2 * 8/2005 Chen ..... G09G 3/3241 345/76
2002/0196212 A1 12/2002 Nishitoba et al.
2003/0052614 A1 3/2003 Howard

FOREIGN PATENT DOCUMENTS

CN 1312535 A 9/2001
CN 101630481 A 1/2010
(Continued)

OTHER PUBLICATIONS

The ISR issued Aug. 8, 2018 by the WIPO.
The CN1OA issued Jan. 23, 2018 by the CNIPA.
The CN2OA issued Jul. 23, 2018 by the CNIPA.

*Primary Examiner* — Mark Edwards
(74) *Attorney, Agent, or Firm* — Qinghong Xu

(57) ABSTRACT

A pixel circuit, a driving method and a display, comprising: a compensation circuit (1) being electrically connected to a driving circuit (2) via a first node (N1); an external power supply (ELVDD), the driving circuit (2) and a light-emitting diode (EL4) being connected in series; a capacitor (C3) being located between the first node (N1) and the external power supply (ELVDD), wherein the compensation circuit (1) is used for setting the voltage of the first node (N1) to a first voltage ($V_{data}+V_{thT1}$) by means of a compensation transistor; the capacitor (C3) is used for maintaining the voltage of the first node (N1) as the first voltage ($V_{data}+V_{thT1}$); the driving circuit (2) externally connects a first control signal (En) to generate a driving current (IEL4) to drive the light-emitting diode (EL4) to emit light; and a driving transistor in the driving circuit (2) and the compensation transistor are common-gate transistors.

15 Claims, 13 Drawing Sheets

(56) References Cited

FOREIGN PATENT DOCUMENTS

| | | | | |
|---|---|---|---|---|
| CN | 105206222 | A | * | 12/2015 |
| CN | 105206222 | A | | 12/2015 |
| CN | 105336292 | A | | 2/2016 |
| CN | 105590955 | A | * | 5/2016 |
| CN | 105590955 | A | | 5/2016 |
| CN | 106128360 | A | | 11/2016 |
| CN | 107038992 | A | | 8/2017 |

* cited by examiner

PIXEL CIRCUIT, METHOD OF DRIVING THE SAME AND DISPLAY USING THE SAME

CROSS-REFERENCE TO RELATED APPLICATIONS

This application is a continuation application of International Application No. PCT/CN2018/087475, filed on May 18, 2018, which is based upon and claims priority to Chinese Patent Application No. 201710369943.5, filed on May 23, 2017, the entire content of all of which is incorporated herein by reference.

TECHNICAL FIELD

The present disclosure relates to the field of electronic display technology, and more particularly, to a pixel circuit, a method of driving the pixel circuit and a display using the pixel circuit.

BACKGROUND

In an existing pixel circuit, generally, a thin film transistor (TFT) is utilized to drive a light-emitting diode (LED) in the pixel circuit to emit light. Such a TFT is referred to as a driving transistor. The driving transistor operates in a saturation state, because a driving current output by the driving transistor in the saturation state is less sensitive to the source-drain voltage than that of the driving transistor in a linear state, so it can provide the LED with more stable driving current. FIG. 1 illustrates a most basic pixel circuit in the related art. As illustrated in FIG. 1, the pixel circuit is consisted of one capacitor C11 and two transistors T11 and T12. When a signal Sn controls the transistor T12 to be turned on, a data signal "data" is written to a node N1 to charge the capacitor C11 and meanwhile drive the driving transistor T11 to be turned on. A driving current generated by T11 allows a LED EL11 located between a first power supply ELVDD and a second power supply ELVSS to emit light. The driving current $I_{EL}$ can be expressed by an Equation I as below:

$$I_{EL} = \frac{1}{2}\mu C_{OX}\frac{W}{L}(V_{GS} + V_{TH})^2 \quad \text{(Equation I)}$$

wherein μ indicates a carrier mobility, $C_{OX}$ indicates a, gale-oxide capacitance per unit area, L indicates a channel length of T11, W indicates a gate width of T11, $V_{GS}$ indicates a gate-source voltage of T11, and $V_{TH}$ indicates a threshold voltage of T11. As can be seen from the Equation 1, a magnitude of the driving current is relevant to the threshold voltage of T11. However, due to the existence of a threshold shift phenomenon, the threshold voltage of the driving transistor T11 is not stable, which leads to a drift of the driving current such that the brightness of the LED is uneven.

In order to solve the above problems, a series of circuits have been proposed, which are referred to as threshold compensation circuits, for eliminating the influence resulted by the threshold shift of the driving transistor. FIG. 2 illustrates an existing threshold compensation circuit. As illustrated in FIG. 2, during a data writing stage, transistors T22 and T23 are turned on by a signal Sn, which leads to a short circuit between a gate electrode and a drain electrode of the driving transistor T21. At the same time, a transistor T25 is turned off by a signal En, a transistor T24 is turned off by a signal Sn-1, and a data signal "data" is input to a source electrode of T21 through T22. At this time, due to the short circuit between the gate electrode and the drain electrode of T21, the data signal is input to the gate electrode through the drain electrode of T21, and a capacitor C21 begins to store electric charges so that a gate voltage of T21 is gradually decreased to a value of ($V_{data}$+$V_{TH}$). Then, T21 enters into a turned-off state, and C21 stops charging. During a light-emitting stage, the signal En drives the transistor T25 to be turned on, the signal Sn-1 turns off the transistor T24, the signal Sn turns off the transistors T22 and T23, and a power supply ELVDD is transmitted to the driving transistor T21 through the transistor T25. At this time, a driving current generated by the driving transistor can be expressed by an Equation II as below:

$$I_{EL} = \frac{1}{2}\mu C_{OX}\frac{W}{L}(V_{ELVDD} - V_{data})^2. \quad \text{(Equation II)}$$

As can be seen from the Equation II, the magnitude of the driving current is no longer relevant to the threshold voltage of the driving transistor T21.

However, in the existing threshold compensation circuit represented by FIG. 2, during the data writing stage, the power supply ELVDD and the data signal are only spaced by the transistor T25. Due to the fact that the magnitude of the voltage of the power supply ELVDD is much greater than that of other signals, and further due to the existence of a leakage current in T25, the data signal tends to be influenced by the power supply ELVDD, which in turn influences luminous stability of the LED.

As above, the problem in the related art involves that the luminance of the LED is unstable.

SUMMARY

The present disclosure provides a pixel circuit, a method of driving the pixel circuit and a display using the pixel circuit, to solve the problem in the existing pixel circuit that the luminance of the LED is unstable.

An embodiment of the first aspect of the present disclosure provides a pixel circuit, including a compensation circuit, a driving circuit, a light-emitting diode, a capacitor and an external power supply.

The compensation circuit is electrically connected to the driving circuit through a first node; the external power supply, the driving circuit and the light-emitting diode are sequentially connected in series; and the capacitor is located between the first node and the external power supply.

The compensation circuit is externally connected to a data signal and a first scanning signal, and is configured to set a voltage of the first node to a first voltage based on the first scanning signal, wherein the first voltage is a voltage obtained upon compensating a voltage of the data signal by a compensation transistor of the compensation circuit.

The capacitor is configured to maintain the voltage of the first node at the first voltage.

The driving circuit is externally connected to a first control signal, and is configured to generate a driving current according to the first control signal so as to drive the light-emitting diode to emit light, wherein the driving current is obtained according to the first voltage, the external power supply and a threshold voltage of a driving transistor in the driving circuit, and the driving transistor and the compensation transistor are configured to share a same gate electrode.

Optionally, the driving transistor and the compensation transistor are mirror transistors.

Optionally, the pixel circuit further includes an initialization circuit.

The initialization circuit is located between the first node and the light-emitting diode; and the initialization circuit is externally connected to a second scanning signal and an initialization voltage.

The initialization circuit is configured to initialize the first node and the light-emitting diode by utilizing the initialization voltage, under a control of the second scanning signal.

Optionally, the initialization circuit includes a first initialization transistor and a second initialization transistor.

A first electrode of the first initialization transistor is externally connected to the initialization voltage; a second electrode of the first initialization transistor is electrically connected to the first node; and a gate electrode of the first initialization transistor is electrically connected to the second scanning signal.

A first electrode of the second initialization transistor is externally connected to the initialization voltage; a second electrode of the second initialization transistor is electrically connected to the light-emitting diode; and a gate electrode of the second initialization transistor is electrically connected to the second scanning signal.

Optionally, the driving circuit includes a driving transistor and a light-emitting control transistor.

A first electrode of the driving transistor is externally connected to the external power supply; a gate electrode of the driving transistor is electrically connected to the compensation circuit; and a second electrode of the driving transistor is electrically connected to a first electrode of the light-emitting control transistor.

A second electrode of the light-emitting control transistor is electrically connected to the light-emitting diode, and a gate electrode of the light-emitting control transistor is externally connected to the first control signal.

Optionally, the driving circuit includes a driving transistor and a light-emitting control transistor.

A first electrode of the light-emitting control transistor is externally connected to the external power supply; a second electrode of the light-emitting control transistor is electrically connected to a first electrode of the driving transistor, and a gate electrode of the light-emitting control transistor is externally connected to the first control signal.

A gate electrode of the driving transistor is electrically connected to the compensation circuit; and a second electrode of the driving transistor is electrically connected to the light-emitting diode.

An embodiment of the second aspect of the present disclosure provides a method of driving a pixel circuit which is applied in the pixel circuit mentioned above, including:

a data writing stage, during which, controlling the first scanning signal to turn on the compensation circuit so that the compensation circuit sets a voltage of the first node to the first voltage; controlling the first control signal to turn off the driving circuit so that the light-emitting diode does not emit light; and maintaining the voltage of the first node at the first voltage by the capacitor, wherein the first voltage is a voltage obtained upon compensating a voltage of the data signal by the compensation transistor of the compensation circuit; and a light-emitting stage, during which, controlling the first scanning signal to turn off the compensation circuit and controlling the first control signal to turn on the driving circuit so that the driving circuit generates a driving current to drive the light-emitting diode to emit light, wherein the driving current is generated according to the first voltage, the external power supply and a threshold voltage of the driving transistor of the driving circuit, and the capacitor is at a maintaining state.

Optionally, before the data writing stage, the method further includes:

an initialization stage, during which, controlling the second scanning signal to turn on the initialization circuit so that the initialization circuit initializes the first node and the light-emitting diode by utilizing an initialization voltage and the capacitor maintains the initialization voltage; and controlling the first scanning signal to turn off the compensation circuit and controlling the first control signal to turn off the driving circuit.

Optionally, the method further includes:

during the data writing stage, controlling the second scanning signal to turn off the initialization circuit; and during the light-emitting stage, controlling the second scanning signal to turn off the initialization circuit.

An embodiment of the third aspect of the present disclosure provides a display including the pixel circuit mentioned above.

To sum up, embodiments of the present disclosure provide a pixel circuit, a method of driving the pixel circuit and a display using the pixel circuit, including a compensation circuit, a driving circuit, a light-emitting diode, a capacitor and an external power supply. The compensation circuit is electrically connected to the driving circuit through a first node; the external power supply, the driving circuit and the light-emitting diode are sequentially connected in series; the capacitor is located between the first node and the external power supply; the compensation circuit is externally connected to a data signal and a first scanning signal and is configured to set a voltage of the first node to a first voltage under the first scanning signal, wherein the first voltage is a voltage obtained upon compensating a voltage of the data signal by the compensation transistor of the compensation circuit; the capacitor is configured to maintain the voltage of the first node at the first voltage; the driving circuit is externally connected to a first control signal and is configured to generate a driving current according to the first control signal so as to drive the light-emitting diode to emit light, wherein the driving current is obtained according to the first voltage, the external power supply and a threshold voltage of a driving transistor in the driving circuit; and the driving transistor and the compensation transistor are configured to share a same gate electrode. The compensation circuit is externally connected to the data signal, and the driving circuit is externally connected to the external power supply, so that during the data writing stage, the data signal is compensated by the compensation transistor of the compensation circuit, that is, the voltage of the data signal is compensated by a threshold voltage of the compensation transistor, so as to obtain the first voltage. The compensation circuit is not externally connected to the external power supply, which avoids influence to the data signal, caused by the external power supply. Furthermore, the driving transistor and the compensation transistor share a same gate electrode, and hence have a same variation tendency in threshold voltage; as a result, compensating the voltage of the data signal by the threshold voltage of the compensation transistor is equivalent to compensating the voltage of the data signal by the threshold voltage of the driving transistor, thereby ensuring the threshold compensation function of the pixel circuit. Therefore, the embodiments of the present disclosure can realize the threshold compensation function of the pixel circuit, and at the same time, avoid influence to the data signal, caused by the external power supply, such that the luminous stability of the LED is increased.

BRIEF DESCRIPTION OF THE DRAWINGS

In order to more clearly illustrate the technical solution of the embodiments of the disclosure, the drawings of the embodiments will be briefly described in the following; it is obvious that the described drawings are only related to some embodiments of the disclosure, from which other drawings are easily conceivable for those skilled in the art without any inventive work.

DETAILED DESCRIPTION

In order to make objects, technical solutions and advantages of the present disclosure apparent, the present disclosure will be further described in detail in connection with the drawings. Apparently, the described embodiments are just a part but not all of the embodiments of the disclosure. Based on the described embodiments herein, those skilled in the art can obtain other embodiment(s), without any inventive work, which should be within the scope of the disclosure.

Figure 1:
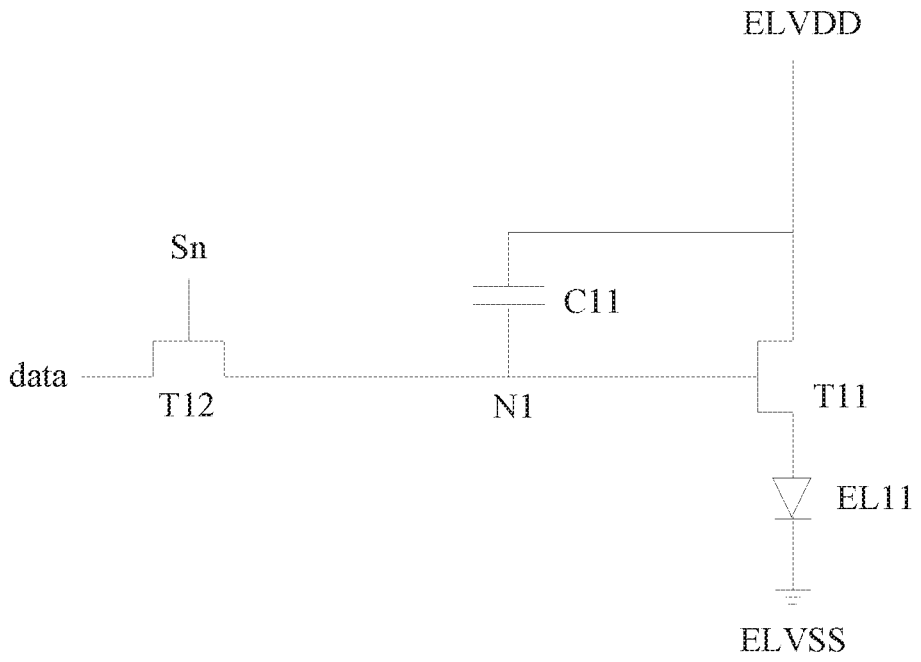
(Prior art) FIG 1
FIG. 1 illustrates a most basic pixel circuit according to the existing technology.
Figure 2:
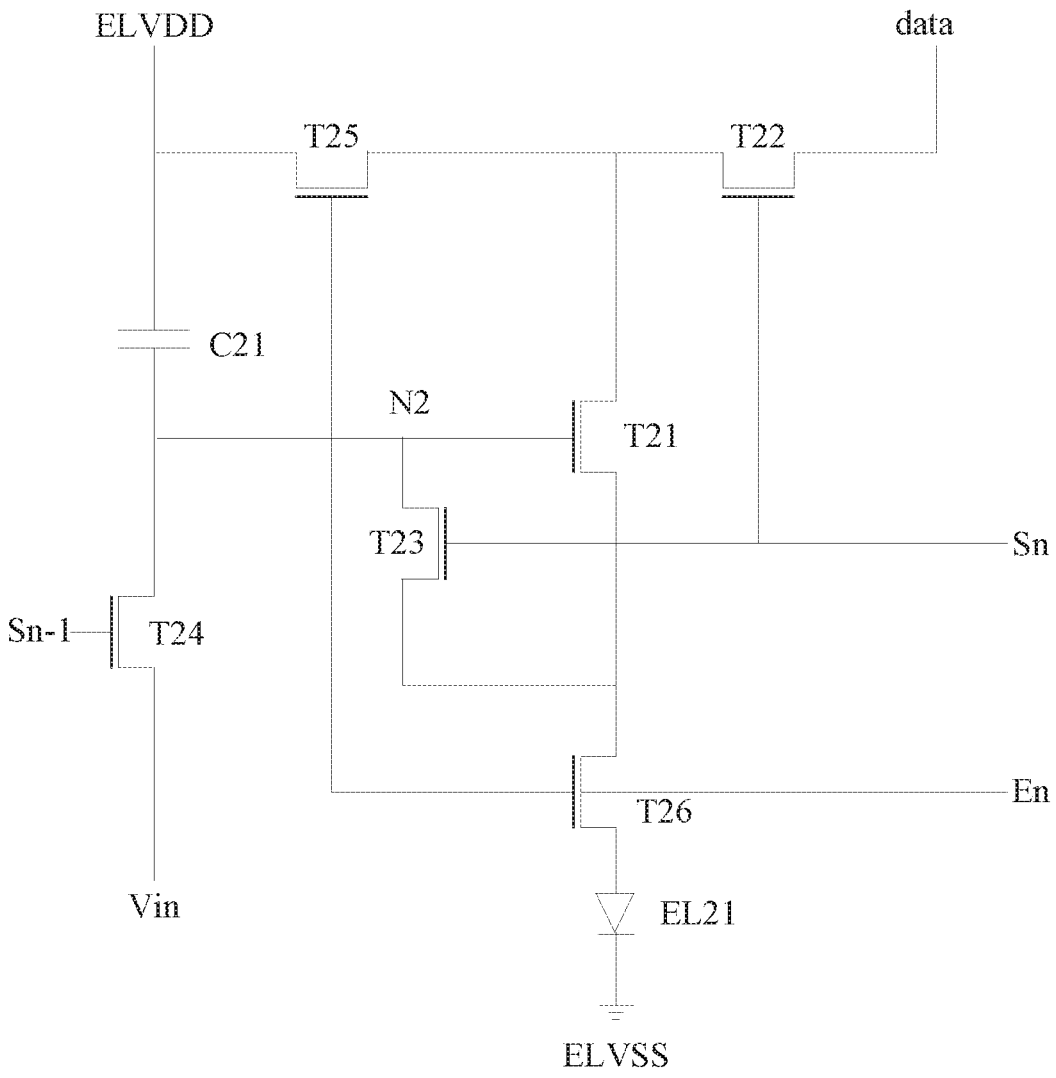
(Prior art) FIG 2
FIG. 2 illustrates a threshold compensation circuit according to the existing technology.
Figure 3:
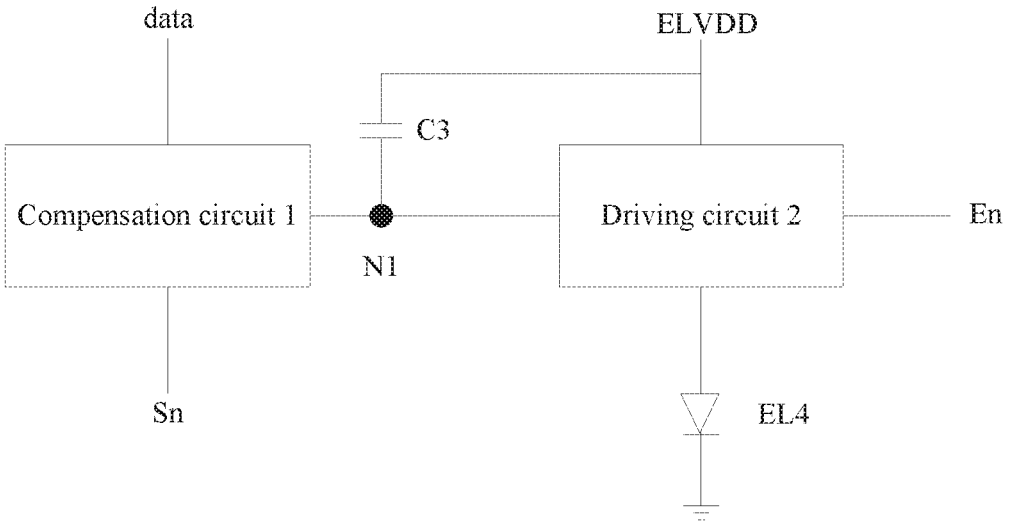
FIG. 3 is a schematic diagram illustrating a structure of a pixel circuit provided by an embodiment of the present disclosure.

An embodiment of the present disclosure discloses a pixel circuit, including a compensation circuit, a driving circuit, a light-emitting diode, a capacitor and an external power supply. The compensation circuit is electrically connected to the driving circuit through a first node. The external power supply, the driving circuit and the light-emitting diode are sequentially connected in series. The capacitor is located between the first node and the external power supply. The compensation circuit is externally connected to a data signal and a first scanning signal and is configured to set a voltage of the first node to be a first voltage under a control of the first scanning signal, wherein the first voltage is a voltage obtained upon compensating a voltage of the data signal by a compensation transistor of the compensation circuit. The capacitor is configured to maintain the voltage of the first node at the first voltage. The driving circuit is externally connected to a first control signal and is configured to generate a driving current according to the first control signal so as to drive the light-emitting diode to emit light. The driving current is obtained according to the first voltage, the external power supply and a threshold voltage of a driving transistor in the driving circuit. The driving transistor and the compensation transistor share a same gate electrode. FIG. 3 is a schematic diagram illustrating a structure of a pixel circuit provided by an embodiment of the present disclosure. As illustrated in FIG. 3, the pixel circuit includes a compensation circuit 1, a driving circuit 2, a capacitor C3, a light-emitting diode EL4 and an external power supply ELVDD. The compensation circuit 1 is electrically connected to the driving circuit 2 through a first node N1. The external power supply ELVDD, the driving circuit 2 and the light-emitting diode EL4 are sequentially connected in series. The capacitor C3 is located between the first node N1 and the external power supply ELVDD. The compensation circuit 1 is externally connected to a data signal "data" and a first scanning signal Sn and is configured to, under a control of the first scanning signal Sn, set a voltage of the first node N1 to a first voltage, i.e., ($V_{data}$+$V_{thT1}$), wherein $V_{thT1}$ indicates a threshold voltage of the compensation transistor in the compensation circuit 1. The capacitor C3 is configured to maintain a voltage of a first node N1 at a first voltage ($V_{data}$+$V_{thT1}$). The driving circuit 2 is externally connected to a first control signal En. When the first control signal En controls the driving circuit 2 to be enabled, the driving circuit 2 generates a driving current so as to drive the light-emitting diode EL4 to emit light. The driving current is obtained according to the first voltage, the external power supply ELVDD and a threshold voltage of the driving transistor in the driving circuit 2. As can be seen from the Equation I, a magnitude of a driving current $I_{EL4}$ flowing through the light-emitting diode EL4 in this case can be expressed by an Equation III as below:

$$I_{ELA} = \frac{1}{2}\mu C_{OX}\frac{W}{L}(V_{ELVDD} - V_{N1} + V_{thT2})^2, \quad \text{(Equation III)}$$

wherein $V_{ELVDD}$ indicates a voltage of the external power supply ELVDD, $V_{N1}$ indicates the first voltage, and $V_{thT2}$ indicates the threshold voltage of the driving transistor. The driving transistor and the compensation transistor share a same gate electrode, hence have a fixed difference value between their threshold voltages, that is, $V_{thT1}-V_{thT2}=A$, wherein A is a constant. As a result, the Equation III can be further converted to an Equation IV as below:

$$I_{EL} = \frac{1}{2}\mu C_{OX}\frac{W}{L}(V_{ELVDD} - V_{data} - A)^2. \quad \text{(Equation IV)}$$

In this way, the influence to the LED resulted by a threshold current of the driving transistor is eliminated. Moreover, in the pixel circuit as illustrated in FIG. 3, the data signal "data" is connected to the compensation circuit 1, the power supply ELVDD is connected to the driving circuit 2, so that during the data writing stage, the data signal "data" is written to the first node N1 by the compensation circuit 1, and during the light-emitting stage, ELVDD is connected to the driving circuit 2, the data signal "data" and the external power supply ELVDD are isolated from each other, such that the influence to the data signal "data" resulted by the external power supply ELVDD can be avoided and the luminous stability of the LED can be improved. During specific implementation, an internal structures of the compensation circuit 1 and the driving circuit 2 are not particularly limited in the embodiments of the present disclosure, and all pixel circuits that satisfy the functions of the compensation circuit 1 and the driving circuit 2 and the interaction relationships therebetween as described in the foregoing embodiments shall be included in the embodiments of the present disclosure.

Optionally, the driving transistor and the compensation transistor are mirror transistors, both having a same threshold voltage. i.e., $V_{thT1}=V_{thT2}$. In this case, the Equation IV can be further simplified as a relational expression indicated by the Equation II.

Figure 4:
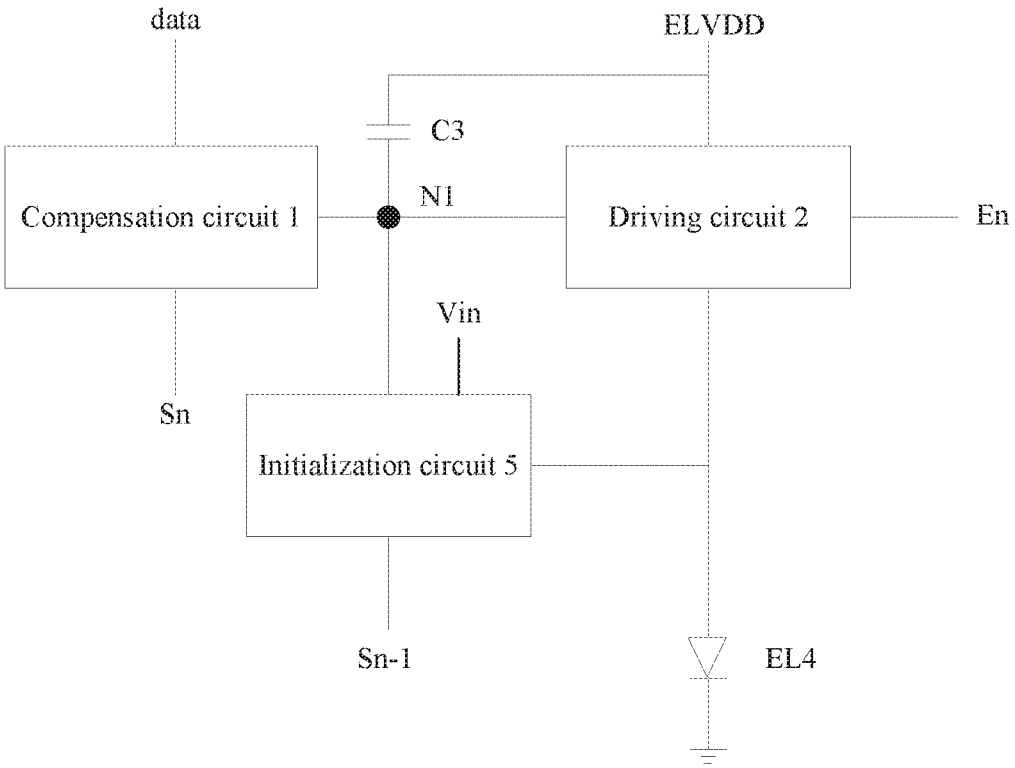
FIG. 4 is a schematic diagram illustrating a structure of a pixel circuit with an initialization function provided by an embodiment of the present disclosure.

Optionally, the pixel circuit provided by the embodiments of the present disclosure can further include an initialization circuit. FIG. 4 is a schematic diagram illustrating structure of a pixel circuit with an initialization function provided by an embodiment of the present disclosure. As illustrated in FIG. 4, an initialization circuit 5 is located between the first node N1 and the light-emitting diode EL4, and is externally connected to a second scanning signal Sn-1 and an initialization voltage Vin. When the second scanning signal Sn-1 enables the initialization circuit, the initialization circuit outputs the initialization voltage to the first node N1 and the light-emitting diode EL4, such that the capacitor C3 discharges until the voltage is decreased to Vin, so that the initializing of the first node N1 and the light-emitting diode EL4 is realized. The initialization process can discharge the voltage at N1 so as to ensure that, during the subsequent data writing stage, the data signal can be written to the node N1. An internal structure of the initialization circuit 5 is not particularly limited in the embodiments of the present disclosure, and all pixel circuits that satisfy the functions of the initialization circuit 5 and its interaction relationships with the compensation circuit 1 and the driving circuit 2 as described in the foregoing embodiments shall be included in the embodiments of the present disclosure.

Figure 5:
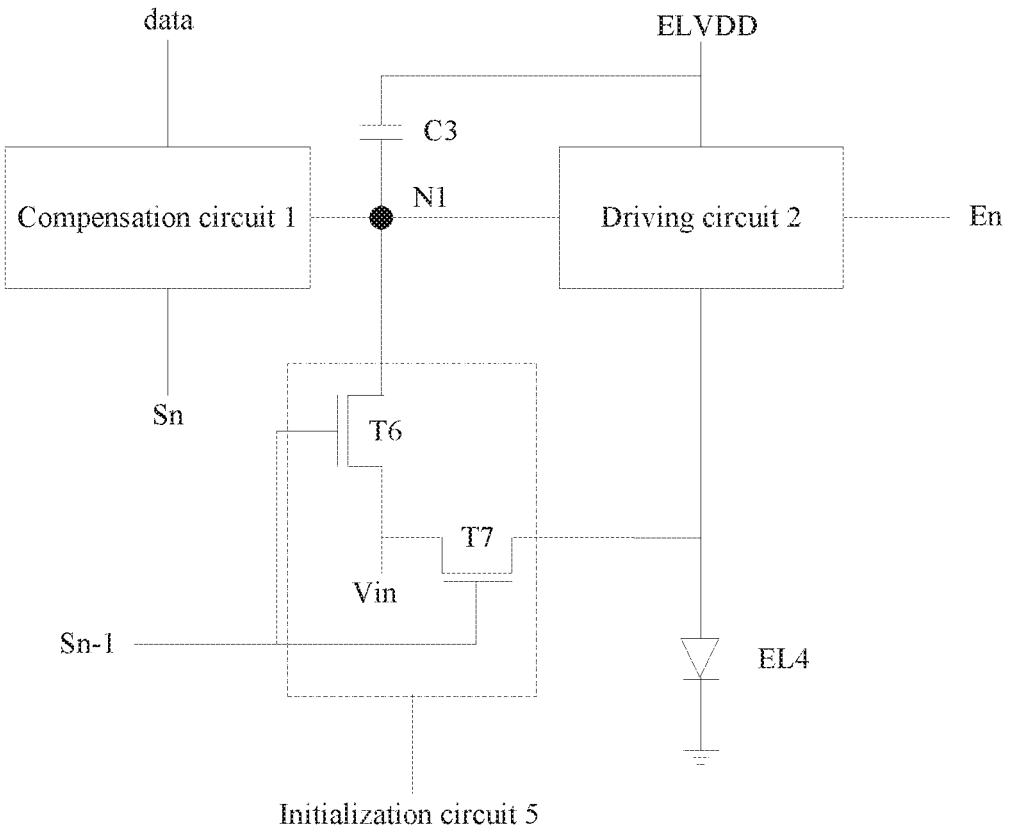
FIG. 5 is a schematic diagram illustrating a structure of an initialization circuit provided by an embodiment of the present disclosure.

Optionally, the embodiment of the present disclosure provides a feasible implementation of the initialization circuit. FIG. 5 is a schematic diagram illustrating a structure of an initialization circuit provided by an embodiment of the present disclosure. As illustrated in FIG. 5, the initialization circuit 5 includes a first initialization transistor T6 and a second initialization transistor T7. A first electrode of the first initialization transistor T6 is externally connected to an initialization voltage Vin; a second electrode of the first initialization transistor T6 is electrically connected to a first node N1; a gate electrode of the first initialization transistor T6 is electrically connected to a second scanning signal Sn-1; a first electrode of the second initialization transistor T7 is externally connected to the initialization voltage Vin; a second electrode of the second initialization transistor T7 is electrically connected to the light-emitting diode EL4; and a gate electrode of the second initialization transistor T7 is electrically connected to the second scanning signal Sn-1. When the first initialization transistor T6 and the second initialization transistor T7 are turned on by the second scanning signal Sn-1, the initialization voltage is transmitted to the first node N1 through the first initialization transistor T6 so as to initialize the first node N1, and is transmitted to the light-emitting diode EL4 through the second initialization transistor T7 so as to initialize the light-emitting diode EL4. During specific implementation, Vin can be an individual initialization signal, and can be the second scanning signal Sn-1 as well. In the case where Vin is the second scanning signal, and when the second scanning signal Sn-1 turns on the first initialization transistor T6 and the second initialization transistor T7, the first initialization transistor T6 and the second initialization transistor T7 are brought into a saturation state, the second scanning signal is input to the first node N1 and to an anode of the light-emitting diode EL4, respectively, through the first initialization transistor T6 and the second initialization transistor T7, until the first initialization transistor T6 and the second initialization transistor T7 are turned off, so as to realize the initialization of the first node N1 and the light-emitting diode EL4.

Figure 6:
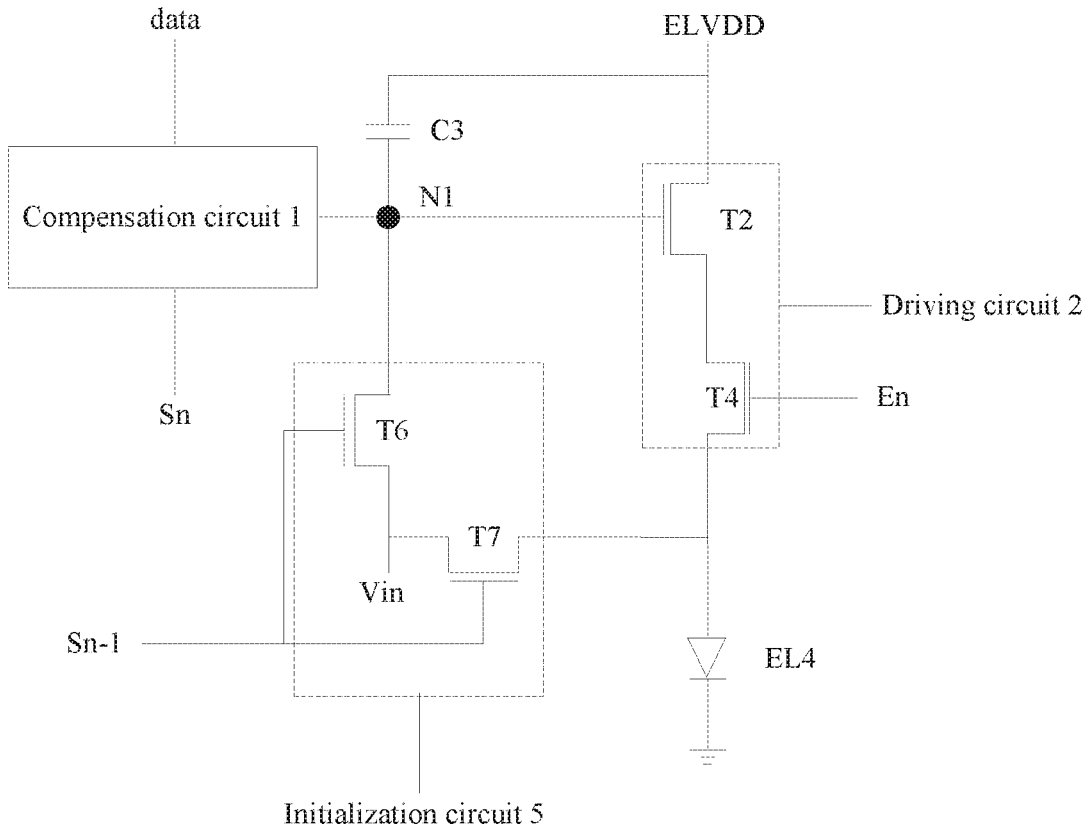
FIG. 6 is a schematic diagram illustrating a structure of a driving circuit provided by an embodiment of the present disclosure.

Optionally, the embodiment of the present disclosure provides a feasible implementation of a driving circuit. FIG. 6 is a schematic diagram illustrating a structure of a driving circuit provided by an embodiment of the present disclosure. As illustrated in FIG. 6, the driving circuit 2 includes a driving transistor T2 and a light-emitting control transistor T4; a first electrode of the driving transistor T2 is externally connected to an external power supply ELVDD; a gate electrode of the driving transistor T2 is electrically connected to the compensation circuit 1; a second electrode of the driving transistor T2 is electrically connected to a first electrode of the light-emitting control transistor T4; a second electrode of the light-emitting control transistor T4 is electrically connected to the light-emitting diode EL4, and a gate electrode of the light-emitting control transistor T4 is externally connected to the first control signal En. When the light-emitting control transistor T4 is turned on by En, the driving transistor T2 generates a driving current according to a gate voltage and the external power supply ELVDD; and the driving current is input to the light-emitting diode EL4 through the light-emitting control transistor T4 and drives the light-emitting diode EL4 to emit light.

Figure 7:
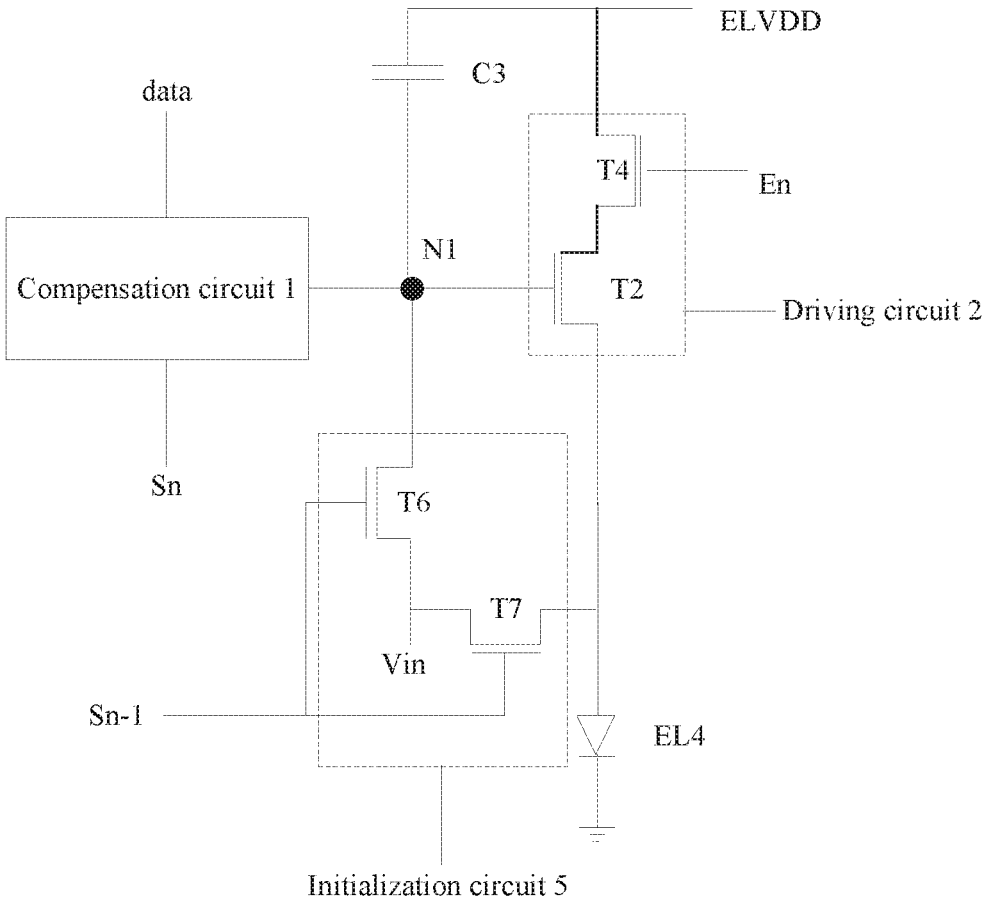
FIG. 7 is a schematic diagram illustrating a structure of another driving circuit provided by an embodiment of the present disclosure.

Optionally, the embodiment of the present disclosure further provides another feasible implementation of a driving circuit. FIG. 7 is a schematic diagram illustrating a structure of another driving circuit provided by an embodiment of the present disclosure. As illustrated in FIG. 7, the driving circuit 2 includes a driving transistor T2 and a light-emitting control transistor T4; a first electrode of the light-emitting control transistor T4 is externally connected to the external power supply ELVDD; a second electrode of the light-emitting control transistor T4 is electrically connected to a first electrode of the driving transistor T2; a gate electrode of the light-emitting control transistor T4 is externally connected to the first control signal En; a gate electrode of the driving transistor T2 is electrically connected to the compensation circuit 1; a second electrode of the driving transistor T2 is electrically connected to the light-emitting diode EL4. When the light-emitting control transistor T4 is turned on by En, the external power supply ELVDD is connected with the first electrode of the driving transistor T2 through the light-emitting control transistor T4, the driving transistor T12 generates a driving current according to a gate voltage and the external power supply ELVDD, and the driving current is input to the light-emitting diode EL4 and drives the light-emitting diode EL4 to emit light.

To sum up, embodiments of the present disclosure provide a pixel circuit, including a compensation circuit, a driving circuit, a light-emitting diode, a capacitor and an external power supply. The compensation circuit is electrically connected to the driving circuit through a first node; the external power supply, the driving circuit and the light-emitting diode are sequentially connected in series; the capacitor is located between the first node and the external power supply; the compensation circuit is externally connected to a data signal and a first scanning signal and is configured to set a voltage of the first node to a first voltage under a control of the first scanning signal, wherein the first voltage is a voltage obtained upon compensating a voltage of the data signal by a compensation transistor of the compensation circuit; the capacitor is configured to maintain the voltage of the first node at the first voltage; the driving circuit is externally connected to a first control signal and is configured to generate a driving current according to the first control signal so as to drive the light-emitting diode to emit light, wherein the driving current is obtained according to the first voltage, the external power supply and a threshold voltage of a driving transistor in the driving circuit; and the driving transistor and the compensation transistor are configured to share a same gate electrode. The compensation circuit is externally connected to the data signal, and the driving circuit is externally connected to the external power supply, so that during the data writing stage, the data signal is compensated by the compensation transistor of the compensation circuit, that is, the voltage of the data signal is compensated by a threshold voltage of the compensation transistor, so as to obtain the first voltage. The compensation circuit is not externally connected to the external power supply, which avoids influence to the data signal, caused by the external power supply. Furthermore, the driving transistor and the compensation transistor share a same gate electrode, and hence have a same variation tendency in threshold voltage; as a result, compensating the voltage of the data signal by the threshold voltage of the compensation transistor is equivalent to compensating the voltage of the data signal by the threshold voltage of the driving transistor, thereby ensuring the threshold compensation function of the pixel circuit. Therefore, the embodiments of the present disclosure can realize the threshold compensation function of the pixel circuit, and at the same time, avoid influence to the data signal, caused by the external power supply, such that the luminous stability of the LED is increased.

Figure 8:
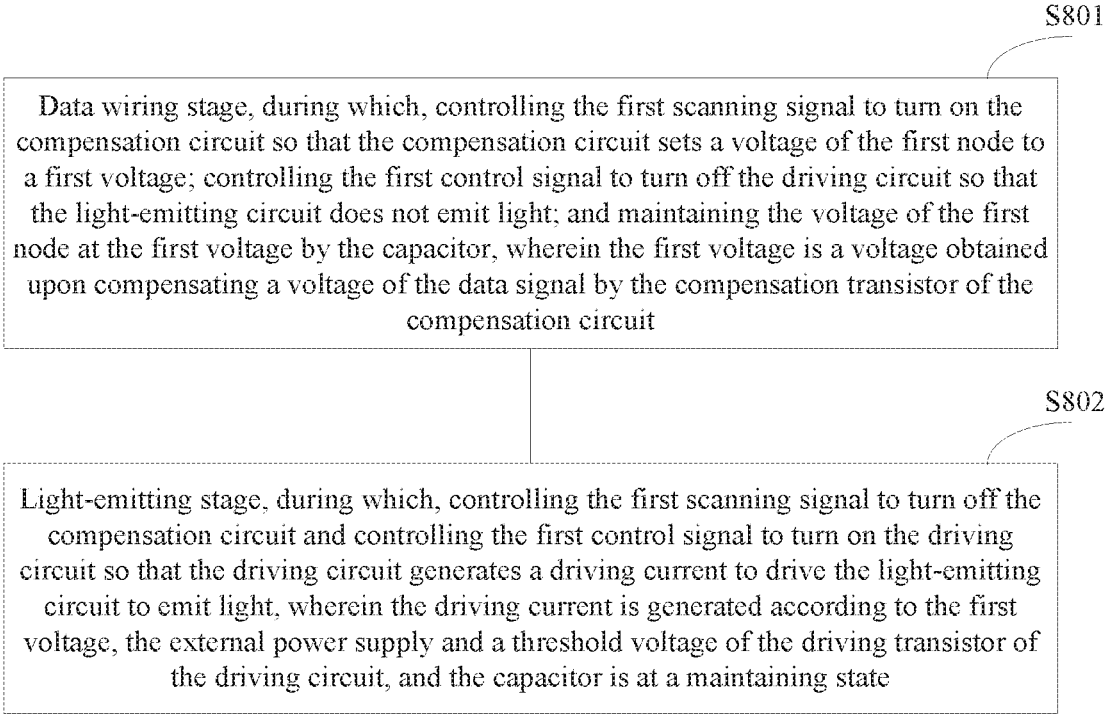
FIG. 8 is a flow chart illustrating a method of driving a pixel circuit provided by an embodiment of the present disclosure.

Based on the same technical conception, the embodiment of the present disclosure further provides a method of driving a pixel circuit, for driving the pixel circuit provided by the embodiments of the present disclosure. FIG. 8 is a flow chart illustrating a method of driving a pixel circuit provided by an embodiment of the present disclosure. As illustrated in FIG. 8, the method includes:

Step S801, during a data writing stage, controlling the first scanning signal to turn on the compensation circuit so that the compensation circuit sets a voltage of the first node to a first voltage; controlling the first control signal to turn off the driving circuit so that the light-emitting diode does not emit light; and maintaining the voltage of the first node at the first voltage by the capacitor, wherein the first voltage is a voltage obtained upon compensating a voltage of the data signal by the compensation transistor of the compensation circuit.

Step S802, during a light-emitting stage, controlling the first scanning signal to turn off the compensation circuit, and controlling the first control signal to turn on the driving circuit so that the driving circuit generates a driving current to drive the light-emitting diode to emit light, wherein the driving current is generated according to the first voltage, the external power supply and a threshold voltage of the driving transistor of the driving circuit, and the capacitor is at a maintaining state.

Figure 9:
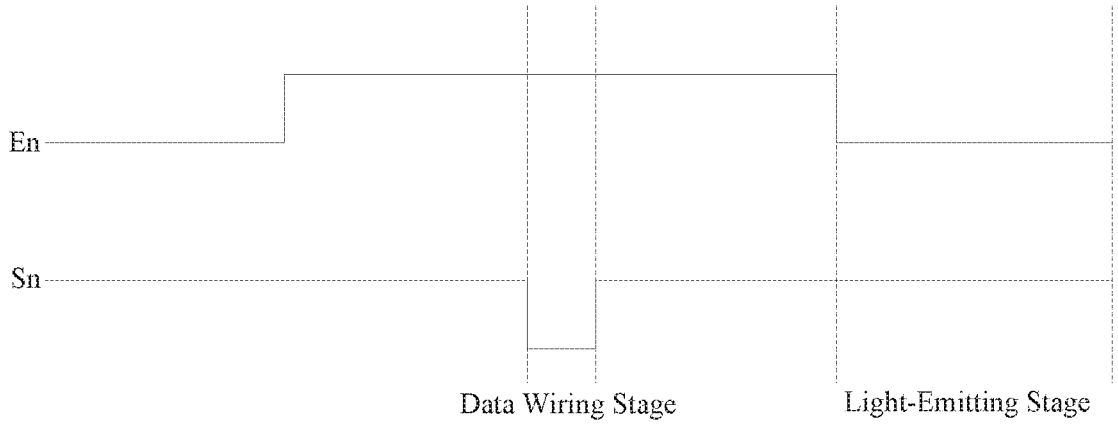
FIG. 9 is a schematic diagram illustrating a driving signal provided by an embodiment of the present disclosure.

During specific implementation, the above-mentioned embodiment is capable of driving the pixel circuit as illustrated in FIG. 3. Optionally, by controlling the transistors of the compensation circuit 1 and the driving circuit 2 to be turned on or turned off, it can realize turning on or tuning off the compensation circuit 1 and the driving circuit 2. In such case, a driving signal corresponding to the pixel circuit as illustrated in FIG. 3 is illustrated as shown in FIG. 9. FIG. 9 is a schematic diagram illustrating a driving signal provided by an embodiment of the present disclosure. The driving signal illustrated in FIG. 9 includes two types of signals, which are the first scanning signal Sn and the first control signal En. FIG. 9 further discloses a time sequence of the first scanning signal Sn and the first control signal En when the transistors of both the compensation circuit 1 and the driving circuit 2 of the pixel circuit illustrated in FIG. 3 are positive channel metal oxide semiconductor (PMOS) transistors.

During the data writing stage, as illustrated in FIG. 9, the first scanning signal Sn is at a low level, the compensation circuit 1 is turned on, the first control signal En is at a high level, and the driving circuit 2 is turned off. The compensation circuit 1 writes the data signal "data" into the first node N1, and the capacitor C3 starts to be charged until a voltage at the first node N1 is set as the first voltage ($V_{data}+V_{thT1}$). Afterwards, the compensation transistor of the compensation circuit 1 is turned off, and the capacitor C3 maintains the voltage of the first node N1 at the first voltage ($V_{data}+V_{thT1}$).

During the light-emitting stage, as illustrated in FIG. 9, the first scanning signal Sn is at the high level, the compensation circuit 1 is turned off, the first control signal En is at the low level, and the driving circuit 2 is turned on. The driving circuit 2 generates a driving current to drive the light-emitting diode EL4 to emit light. Since the voltage at the first node is the first voltage ($V_{data}+V_{thT1}$), a threshold compensation can be realized on the gate voltage of the driving transistor of the driving circuit 2, so that the driving current is no longer influenced by the threshold drift of the driving transistor.

Figure 10:
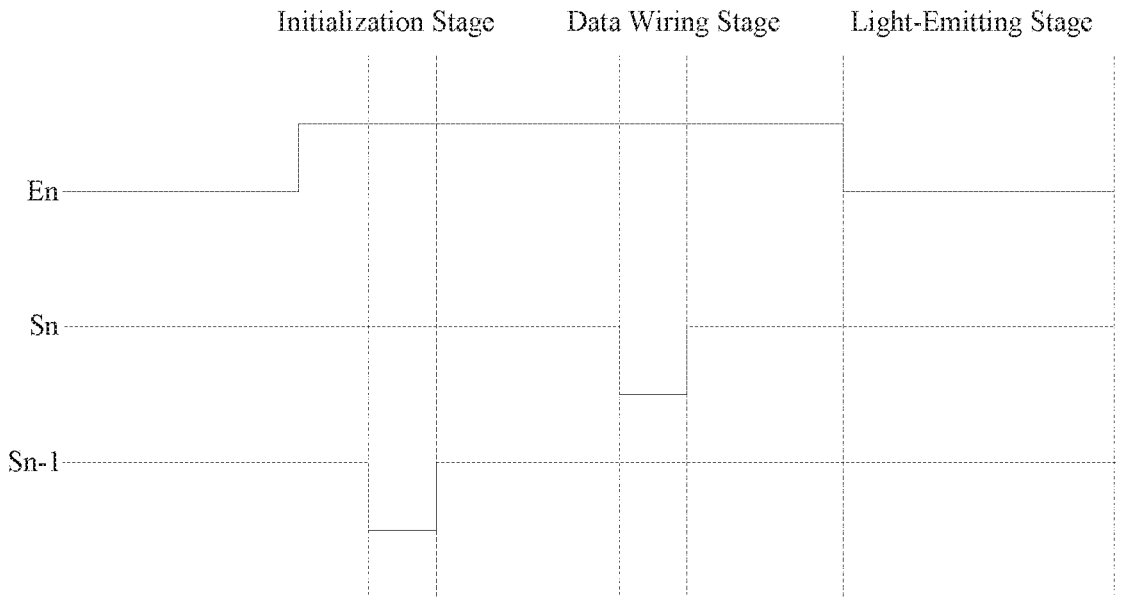
FIG. 10 is a schematic diagram illustrating another driving signal provided by an embodiment of the present disclosure.

Corresponding to the pixel circuit as illustrated in FIG. 4, the embodiment of the present disclosure further provides another method of driving a pixel circuit. FIG. 10 is a schematic diagram illustrating a driving signal provided by an embodiment of the present disclosure. As illustrated in FIG. 10, the driving signal includes a first scanning signal Sn, a second scanning signal Sn-1 and a first control signal En. In addition, it further illustrates a time sequence of the first scanning signal Sn, the second scanning signal Sn-1 and the first control signal En when the transistors of the compensation circuit 1, the driving circuit 2 and the initialization circuit 5 of the pixel circuit illustrated in FIG. 4 are PMOS transistors. Prior to the data writing stage, the method shall further include an initialization stage, specifically:

during the initialization stage, controlling the second scanning signal Sn-1 to turn on the initialization circuit 5, so that the initialization circuit 5 initializes the first node N1 and the light-emitting diode EL4 by utilizing an initialization voltage Vin, wherein the capacitor C3 maintains the initialization voltage Vin; and controlling the first scanning signal Sn to turn off the compensation circuit 1, and controlling the first control signal En to turn off the driving circuit 2.

During the data writing stage, as illustrated in FIG. 10, the first scanning signal Sn is at the low level, the compensation circuit 1 is turned on, the first control signal En is at the high level, and the driving circuit 2 is turned off, and the second scanning signal Sn-1 is at the high level, the initialization circuit is turned off. The compensation circuit 1 writes the data signal "data" into the first node N1, and the capacitor C3 starts to be charged until a voltage at the first node N1 is set as the first voltage ($V_{data}+V_{thT1}$). Afterwards, the compensation transistor in the compensation circuit 1 is turned off, and the capacitor C3 maintains the voltage of the first node N1 at the first voltage ($V_{data}+V_{thT1}$).

During the light-emitting stage, as illustrated in FIG. 10, the first scanning signal Sn is at the high level, the compensation circuit 1 is turned off, the second scanning signal Sn-1 is at the high level, the initialization circuit is turned off, the first control signal En is at the low level, and the driving circuit 2 is enabled. The driving circuit 2 generates a driving current to drive the light-emitting diode EL4 to emit light. Since the voltage at the first node N1 is the first voltage ($V_{data}+V_{thT1}$) a threshold compensation can be realized on the gate voltage of the driving transistor of the driving circuit 2 so that the driving current is no longer influenced by the threshold drift of the driving transistor.

In order to solve the problems in the existing technology that the luminance of the LED is not stable, the embodiments of the present disclosure further optimize the existing threshold compensation circuit, such that an influence to the data signal, caused by the external power supply is avoided, thus stabilizing the luminance of the LED. Hereinafter, several particular implementations are described by taking examples of PMOS. It shall be noted that, variants of the following particular implementations such as NMOS or COMS circuits shall be failing into the scope of protection of the embodiments of the present disclosure as well. The present disclosure is not intended to enumerate all the variants of pixel circuits, but only to introduce some of the pixel circuits for purpose of explaining the technical solutions disclosed in the embodiments of the present disclosure.

The First Embodiment

Figure 11:
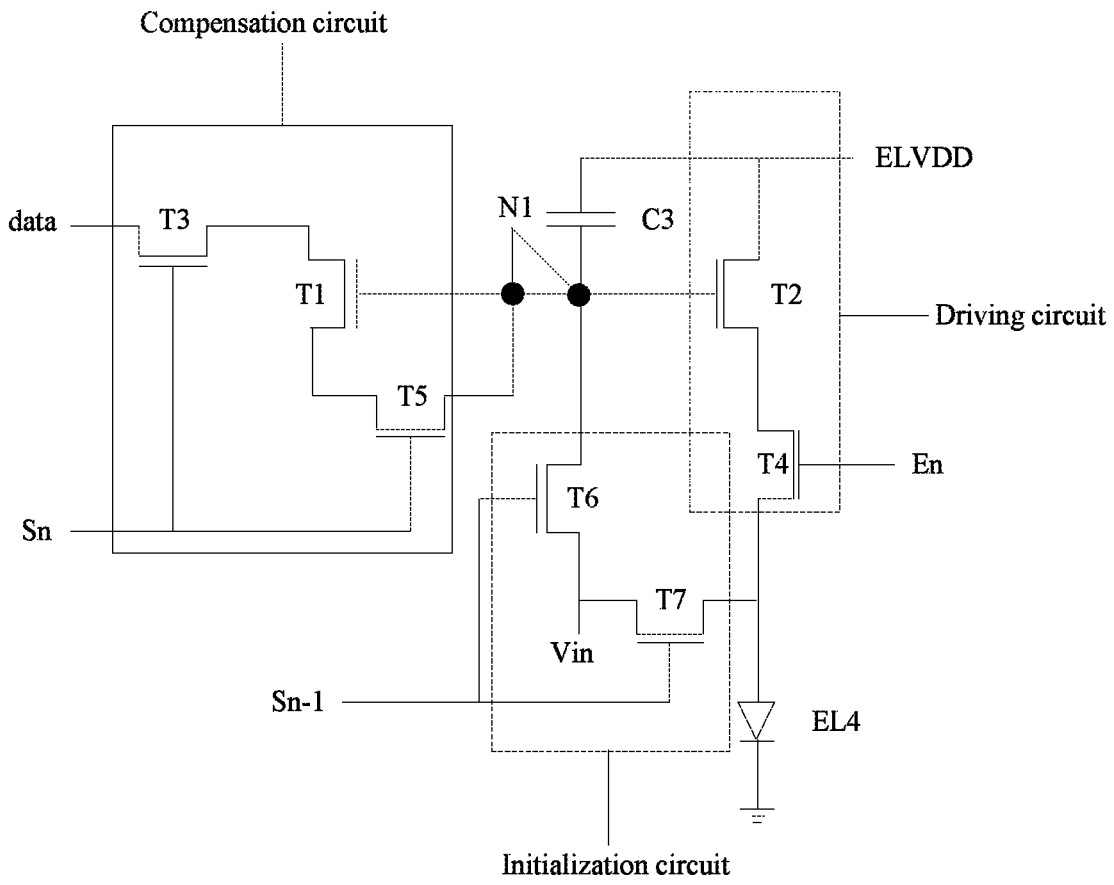
FIG. 11 illustrates one of feasible implementations of a pixel circuit provided by an embodiment of the present disclosure.

FIG. 11 illustrates one of feasible implementations of a pixel circuit provided by an embodiment of the present disclosure. As illustrated in FIG. 11, the compensation circuit includes a data strobe transistor T3, a compensation transistor T1 and a switch transistor T5; the driving circuit includes a driving transistor T2 and a light-emitting control transistor T4; and the initialization circuit includes a first initialization transistor T6 and a second initialization transistor T7.

In the compensation circuit, a drain electrode of the data strobe transistor T3 is electrically connected to a source electrode of the compensation transistor T1; a source electrode of the data strobe transistor T3 is electrically connected to a data signal "data"; a gate electrode of the data strobe transistor T3 is electrically connected to a first scanning signal Sn; and a gate electrode of the compensation transistor T1 is electrically connected to a gate electrode of the driving transistor T2 through a first node N1, and a drain electrode of the compensation transistor T1 is electrically connected to a source electrode of the switch transistor T5. A drain electrode of the switch transistor T5 is electrically connected to the gate electrode of the compensation transistor T1; and a gate electrode of the switch transistor T5 is electrically connected to the first scanning signal Sn.

In the driving circuit, a source electrode of the driving transistor T2 is externally connected to an external power supply ELVDD; a drain electrode of the driving transistor T2 is electrically connected to a source electrode of the light-emitting control transistor T4; a drain electrode of the light-emitting control transistor T4 is electrically connected to the light-emitting diode EL4; and a gate electrode of the light-emitting control transistor T4 is externally connected to the first control signal En.

In the initialization circuit, a source electrode of the first initialization transistor T6 is externally connected to an initialization voltage Vin; a drain electrode of the first initialization transistor T6 is electrically connected to the first node N1; a gate electrode of the first initialization transistor T6 is electrically connected to a second scanning signal Sn-1; a source electrode of the second initialization transistor T7 is externally connected to the initialization voltage Vin; a drain electrode of the second initialization transistor T7 is electrically connected to the light-emitting diode EL4; and a gate electrode of the second initialization transistor T7 is electrically connected to the second scanning signal Sn-1.

The capacitor C3 is located between the first node N1 and the external power supply ELVDD.

According to the driving signal as illustrated in FIG. 10, a method of driving a pixel circuit as illustrated in FIG. 11 includes:

An initialization stage, during which, the first scanning signal Sn is at the high level so that the data strobe transistor T3 and the switch transistor T5 are turned off, the compensation circuit is disenabled. The first control signal En is at the high level so that the light-emitting control transistor T4 is turned off, and the driving circuit is disenabled. The second control signal Sn-1 is at the low level so that the first initialization transistor T6 and the second initialization transistor T7 are turned on; the first initialization transistor T6 transmits the initialization voltage to the first node N1 so as to initialize the first node N1, and the second initialization transistor T7 transmits the initialization voltage Vin to the light-emitting diode EL4 so as to initialize the light-emitting diode EL4.

A data writing stage, during which, the first scanning signal Sn is at the low level so that the data strobe transistor T3 and the switch transistor T5 are turned on, and the compensation circuit is enabled. The first control signal En is at the high level so that the light-emitting control transistor 14 is turned off and the driving circuit is disenabled. The second scanning signal Sn-1 is at the high level so that the first initialization transistor T6 and the second initialization transistor T7 are turned off and the initialization circuit is disenabled. The data signal "data" arrives at the source electrode of the compensation transistor T1 through the data strobe transistor T3; since the switch transistor T5 is turned on, the compensation transistor T1 is working at a saturation region, and the data signal "data" is written to the first node N1 until the voltage of the first node N1 reaches the first voltage ($V_{data}+V_{thT1}$), then the compensation transistor T1 is turned off.

A light-emitting stage, during which, the first scanning signal Sn is at the high level so that the data strobe transistor T3 and the switch transistor T5 are turned off, the compensation circuit is disenabled. The first control signal En is at the low level so that the light-emitting control transistor T4 is turned on, and the driving circuit is enabled. The second scanning signal Sn-1 is at the high level so that the first initialization transistor T6 and the second initialization transistor T7 are turned off and the initialization circuit is disenabled. The driving transistor T2 generates a driving current to drive the light-emitting diode EL4 to emit light. Since the voltage at the first node N1 is the first voltage ($V_{data}+V_{thT1}$), a threshold compensation can be realized on the gate voltage of the driving transistor so that the driving current is no longer influenced by the threshold drift of the driving transistor T2.

The Second Embodiment

Figure 12:
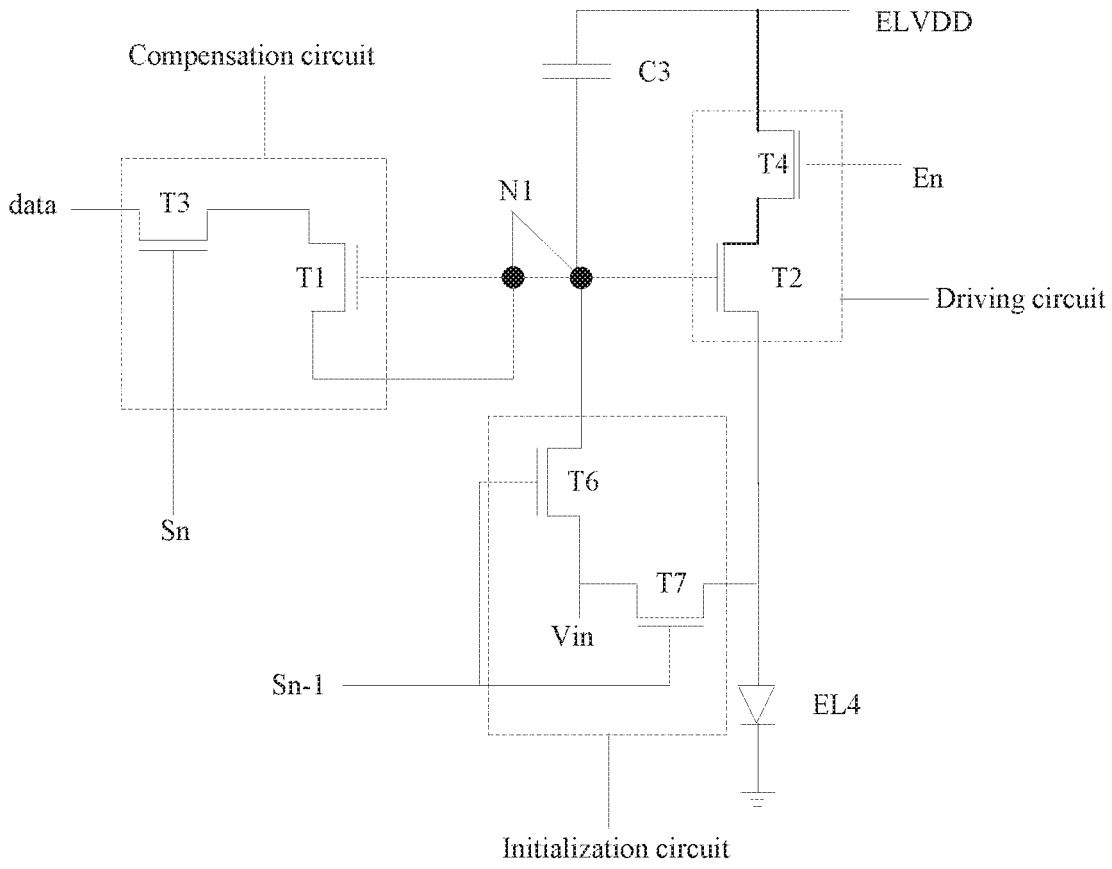
FIG. 12 illustrates one feasible implementation of another pixel circuit provided by an embodiment of the present disclosure.

FIG. 12 illustrates one of feasible implementations of a pixel circuit provided by an embodiment of the present disclosure. As illustrated in FIG. 12, the compensation circuit includes a data strobe transistor T3 and a compensation transistor T1; the driving circuit includes a driving transistor T2 and a light-emitting control transistor T4; and the initialization circuit includes a first initialization transistor T6 and a second initialization transistor T7.

In the compensation circuit, a drain electrode of the data strobe transistor T3 is electrically connected to a source electrode of the compensation transistor T1; a source electrode of the data strobe transistor T3 is electrically connected to a data signal "data"; a gate electrode of the data strobe transistor T3 is electrically connected to a first scanning signal Sn; and a gate electrode of the compensation transistor T1 is electrically connected to a gate electrode of the driving transistor T2 through a first node N1, and a drain electrode of the compensation transistor T1 is electrically connected to the gate electrode of the compensation transistor T1.

In the driving circuit, a source electrode of the driving transistor T2 is externally connected to an external power supply ELVDD; a drain electrode of the driving transistor T2 is electrically connected to a source electrode of the light-emitting control transistor T4; and a drain electrode of the light-emitting control transistor T4 is electrically connected to the light-emitting diode EL4, and a gate electrode of the light-emitting control transistor T4 is externally connected to the first control signal En.

In the initialization circuit, a source electrode of the first initialization transistor T6 is externally connected to an initialization voltage Vin; a drain electrode of the first initialization transistor T6 is electrically connected to the first node N1; a gate electrode of the first initialization transistor T6 is electrically connected to a second scanning signal Sn-1; a source electrode of the second initialization transistor T7 is externally connected to the initialization voltage Vin; a drain electrode of the second initialization transistor T7 is electrically connected to the light-emitting diode EL4; and a gate electrode of the second initialization transistor T7 is electrically connected to the second scanning signal Sn-1.

The capacitor C3 is located between the first node N1 and the external power supply ELVDD.

According to the driving signal as illustrated in FIG. 10, a method of driving a pixel circuit as illustrated in FIG. 12 includes:

An initialization stage, during which, the first scanning signal Sn is at the high level so that the data strobe transistor T3 is turned off, and the compensation circuit is disenabled. The first control signal En is at the high level so that the light-emitting control transistor T4 is turned off, and the driving circuit is disenabled. The second control signal Sn-1 is at the low level so that the first initialization transistor T6 and the second initialization transistor T7 are turned on; and the first initialization transistor T6 transmits the initialization voltage to the first node N1 so as to initialize the first node N1, and the second initialization transistor T7 transmits the initialization voltage Vin to the light-emitting diode EL4 so as to initialize the light-emitting diode EL4.

A data writing stage, during, the first scanning signal Sn is at the low level so that the data strobe transistor T3 is turned on, and the compensation circuit is enabled. The first control signal En is at the high level so that the light-emitting control transistor T4 is turned off and the driving circuit is disenabled. The second scanning signal Sn-1 is at the high level so that the first initialization transistor T6 and the second initialization transistor T7 are turned off and the initialization circuit is disenabled. The data signal "data" arrives at the source electrode of the compensation transistor T1 through the data strobe transistor T3; and due to a short circuit between the drain electrode and the gate electrode of the compensation transistor T1, the compensation transistor T1 is working at a saturation region, and the data signal "data" is written to the first node N1 until the voltage of the first node N1 reaches the first voltage ($V_{data}+V_{thT1}$), then the compensation transistor T1 is turned off.

A light-emitting stage, during which, the first scanning signal Sn is at the high level so that the data strobe transistor T3 is turned off, and the compensation circuit is disenabled. The first control signal En is at the low level so that the light-emitting control transistor T4 is turned on, and the driving circuit is enabled. The second scanning signal Sn-1 is at the high level so that the first initialization transistor T6 and the second initialization transistor T7 are turned off and the initialization circuit is disenabled. The driving transistor T2 generates a driving current to drive the light-emitting diode EL4 to emit light. Since the voltage at the first node is the first voltage ($V_{data}+V_{thT1}$), a threshold compensation can be realized on the gate voltage of the driving transistor so that the driving current is no longer influenced by the threshold drift of the driving transistor T2.

In the above-described first and second embodiments, the following several points need to be particularly pointed out:

(1) The second initialization transistor T7 may be externally connected to the first scanning signal or a third scanning signal as well, so that the first node N1 and the light-emitting diode EL4 may not be initialized simultaneously, thereby avoiding, when initialization is applied on the first node N1 and the light-emitting diode EL4 simultaneously, excessively large instantaneous current caused by the initialization voltage Vin, to burn-out the pixel circuit or the power supply circuit that supplies power to the pixel circuit.

(2) Only the compensation transistor T1 and the switch transistor T5 can be left in the compensation circuit in FIG. 11 and the data strobe transistor T3 can be omitted, and the purpose is that at least one of the switch transistor T5 and the data strobe transistor T3 is included in the compensation circuit.

(3) The first initialization transistor T6 and the second initialization transistor T7 of the initialization circuit can be connected in such a manner as well that, the first electrode of the first initialization transistor T6 is electrically connected to the first node N1, the gate electrode of the first initialization transistor T6 is externally connected to the second scanning signal Sn-1, the second electrode of the first initialization transistor T6 is electrically connected to the light-emitting diode EL4, the first electrode of the second initialization transistor T7 is electrically connected to the light-emitting diode EL4, the second electrode of the second initialization transistor T7 is externally connected to the initialization voltage Vin, and the gate electrode of the second initialization transistor T7 is externally connected to the second scanning signal Sn-1. The first initialization transistor T6 and the second initialization transistor T7 are formed into a single, dual-gate transistor. By utilizing a single dual-gate transistor to replace the original transistors T6 and T7, the number of transistors used in the pixel circuit is reduced, and the circuit structure is simplified.

Figure 13:
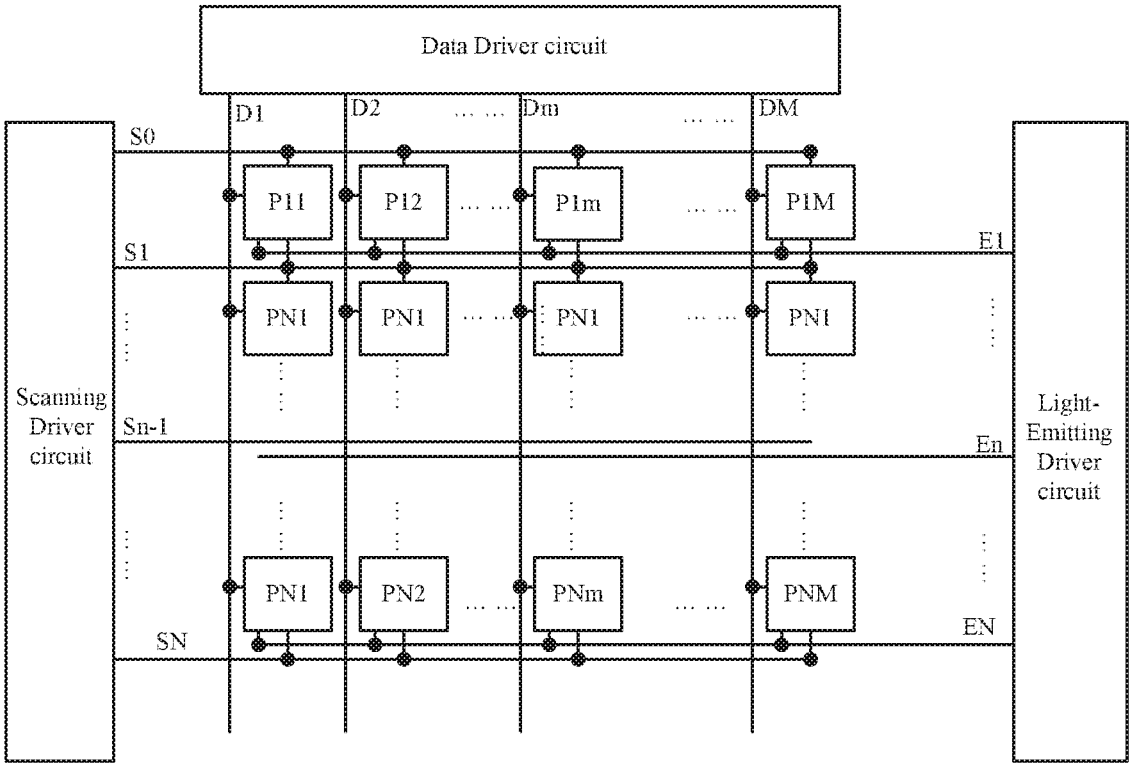
FIG. 13 is a schematic diagram illustrating a structure of a display provided by an embodiment of the present disclosure.

Based on the same technical conception, the embodiment of the present disclosure further provides a display adopting the pixel circuit provided by any of the foregoing embodiments. FIG. 13 is a schematic diagram illustrating a structure of a display provided by an embodiment of the present disclosure. As illustrated in FIG. 13, the display includes: a N×M array of pixel circuits (P11, P12 . . . PNM); a scanning driver circuit generating a scanning signal S0, S1, S2 . . . SN, wherein Sn is a scanning signal input into a $n^{th}$ row of pixels by the scanning driver circuit, n=1, 2, . . . N; a data driver circuit generating total M data signals D1, D2 . . . DM corresponding to M columns of pixels, respectively, wherein Dm is the data signal "data" of a $m^{th}$ column of pixels, m=1, 2, . . . M; and a light-emitting driver circuit generating a first control signal E1, E2 . . . EN, wherein En is the first control signal input into the $n^{th}$ row of pixels by the light-emitting driver circuit, n=1, 2, . . . N.

Embodiments of the present disclosure provide a pixel circuit, a method of driving the pixel circuit and a display using the pixel circuit, including a compensation circuit, a driving circuit, a light-emitting diode, a capacitor and an external power supply. The compensation circuit is electrically connected to the driving circuit through a first node; the external power supply, the driving circuit and the light-emitting diode are sequentially connected in series; the capacitor is located between the first node and the external power supply; the compensation circuit is externally connected to a data signal and a first scanning signal and is configured to set a voltage of the first node to a first voltage under the first scanning signal, wherein the first voltage is a voltage obtained upon compensating a voltage of the data signal by the compensation transistor of the compensation circuit; the capacitor is configured to maintain the voltage of the first node at the first voltage; the driving circuit is externally connected to a first control signal and is configured to generate a driving current according to the first control signal so as to drive the light-emitting diode to emit light, wherein the driving current is obtained according to the first voltage, the external power supply and a threshold voltage of a driving transistor in the driving circuit; and the driving transistor and the compensation transistor are configured to share a same gate electrode. The compensation circuit is externally connected to the data signal, and the driving circuit is externally connected to the external power supply, so that during the data writing stage, the data signal is compensated by the compensation transistor of the compensation circuit, that is, the voltage of the data signal is compensated by a threshold voltage of the compensation transistor, so as to obtain the first voltage. The compensation circuit is not externally connected to the external power supply, which avoids influence to the data signal, caused by the external power supply. Furthermore, the driving transistor and the compensation transistor share a same gate electrode, and hence have a same variation tendency in threshold voltage; as a result, compensating the voltage of the data signal by the threshold voltage of the compensation transistor is equivalent to compensating the voltage of the data signal by the threshold voltage of the driving transistor, thereby ensuring the threshold compensation function of the pixel circuit. Therefore, the embodiments of the present disclosure can realize the threshold compensation function of the pixel circuit, and at the same time, avoid influence to the data signal, caused by the external power supply, such that the luminous stability of the LED is increased.

Although preferred embodiments of the present disclosure have been described, those skilled in the art should be appreciated that, other modifications and variants may be made to these embodiments upon learning the basic inventive conception. Therefore, the appended claims are intended to be interpreted as encompassing the preferred embodiments and all the modifications and variants which are fallen into the scope of the present disclosure.

Obviously, various modifications and variants may be made to the present disclosure by those skilled in the art without departing from the spirit and scope of the present disclosure. In this way, the present disclosure is intended to encompass these alternations and modifications which are pertaining to the scope of the claims of the present disclosure and the equivalents thereof.

What is claimed is:

1. A pixel circuit, comprising a compensation circuit, a driving circuit, a light-emitting diode, a capacitor and an external power supply, wherein the compensation circuit is electrically connected to the driving circuit through a first node; the external power supply, the driving circuit and the light-emitting diode are sequentially connected in series; and the capacitor is located between the first node and the external power supply, the compensation circuit is externally connected to a data signal and a first scanning signal and is configured to set a voltage of the first node to a first voltage under the first scanning signal, wherein the first voltage is a voltage obtained upon compensating a voltage of the data signal by a compensation transistor of the compensation circuit, the capacitor is configured to maintain the voltage of the first node at the first voltage, and the driving circuit is externally connected to a first control signal and is configured to generate a driving current according to the first control signal so as to drive the light-emitting diode to emit light, wherein the driving current is obtained according to the first voltage, the external power supply and a threshold voltage of a driving transistor in the driving circuit; and the driving transistor and the compensation transistor are configured to share a same gate electrode, wherein the compensation circuit comprises a data strobe transistor, the compensation transistor and a switch transistor, and a drain electrode of the data strobe transistor is electrically connected to a source electrode of the compensation transistor; a source electrode of the data strobe transistor is electrically connected to the data signal; a gate electrode of the data strobe transistor is electrically connected to the first scanning signal; a gate electrode of the compensation transistor is electrically connected to a gate electrode of the driving transistor through the first node, and a drain electrode of the compensation transistor is electrically connected to a source electrode of the switch transistor; a drain electrode of the switch transistor is electrically connected to the gate electrode of the compensation transistor; and a gate electrode of the switch transistor is electrically connected to the first scanning signal.

2. The pixel circuit according to claim 1, wherein the driving transistor and the compensation transistor are mirror transistors.

3. The pixel circuit according to claim 1, further comprising an initialization circuit, wherein the initialization circuit is located between the first node and the light-emitting diode; and the initialization circuit is externally connected to a second scanning signal and an initialization voltage, and the initialization circuit is configured to initialize the first node and the light-emitting diode by utilizing the initialization voltage, under a control of the second scanning signal.

4. The pixel circuit according to claim 3, wherein the initialization circuit comprises a first initialization transistor and a second initialization transistor, a first electrode of the first initialization transistor is externally connected to the initialization voltage; a second electrode of the first initialization transistor is electrically connected to the first node; and a gate electrode of the first initialization transistor is electrically connected to the second scanning signal, and a first electrode of the second initialization transistor is externally connected to the initialization voltage; a second electrode of the second initialization transistor is electrically connected to the light-emitting diode; and a gate electrode of the second initialization transistor is electrically connected to the second scanning signal.

5. The pixel circuit according to claim 1, wherein the driving circuit comprises a driving transistor and a light-emitting control transistor, a first electrode of the driving transistor is externally connected to the external power supply; a gate electrode of the driving transistor is electrically connected to the compensation circuit; and a second electrode of the driving transistor is electrically connected to a first electrode of the light-emitting control transistor, and a second electrode of the light-emitting control transistor is electrically connected to the light-emitting diode, and a gate electrode of the light-emitting control transistor is externally connected to the first control signal.

6. The pixel circuit according to claim 1, wherein the driving circuit comprises a driving transistor and a light-emitting control transistor, a first electrode of the light-emitting control transistor is externally connected to the external power supply; a second electrode of the light-emitting control transistor is electrically connected to a first electrode of the driving transistor; and a gate electrode of the light-emitting control transistor is externally connected to the first control signal, and a gate electrode of the driving transistor is electrically connected to the compensation circuit; and a second electrode of the driving transistor is electrically connected to the light-emitting diode.

7. A method of driving a pixel circuit, applied to a pixel circuit, wherein the pixel circuit comprises a compensation circuit, a driving circuit, a light-emitting diode, a capacitor and an external power supply, wherein the compensation circuit is electrically connected to the driving circuit through a first node; the external power supply, the driving circuit and the light-emitting diode are sequentially connected in series; and the capacitor is located between the first node and the external power supply, the compensation circuit is externally connected to a data signal and a first scanning signal and is configured to set a voltage of the first node to a first voltage under the first scanning signal, the capacitor is configured to maintain the voltage of the first node at the first voltage, and the driving circuit is externally connected to a first control signal and is configured to generate a driving current according to the first control signal so as to drive the light-emitting diode to emit light, wherein the driving current is obtained according to the first voltage, the external power supply and a threshold voltage of a driving transistor in the driving circuit; and the driving transistor and the compensation transistor are configured to share a same gate electrode, wherein the compensation circuit comprises a data strobe transistor, the compensation transistor and a switch transistor; a drain electrode of the data strobe transistor is electrically connected to a source electrode of the compensation transistor; a source electrode of the data strobe transistor is electrically connected to the data signal; a gate electrode of the data strobe transistor is electrically connected to the first scanning signal; a gate electrode of the compensation transistor is electrically connected to a gate electrode of the driving transistor through the first node, and a drain electrode of the compensation transistor is electrically connected to a source electrode of the switch transistor; a drain electrode of the switch transistor is electrically connected to the gate electrode of the compensation transistor; a gate electrode of the switch transistor is electrically connected to the first scanning signal; and the method comprises:

a data writing stage, during which, controlling the first scanning signal to turn on the compensation circuit so that the compensation circuit sets a voltage of the first node to the first voltage; and controlling the first control signal to turn off the driving circuit so that the light-emitting diode does not emit light; and maintaining a voltage of the first node at the first voltage by the capacitor, wherein the first voltage is a voltage obtained upon compensating a voltage of the data signal by the compensation transistor of the compensation circuit; and a light-emitting stage, during which, controlling the first scanning signal to turn off the compensation circuit; and controlling the first control signal to turn on the driving circuit so that the driving circuit generates the driving current to drive the light-emitting diode to emit light, and the capacitor is at a maintaining state.

8. The method according to claim 7, wherein the pixel circuit further comprises an initialization circuit, wherein the initialization circuit is located between the first node and the light-emitting diode; and the initialization circuit is externally connected to a second scanning signal and an initialization voltage, and before the data writing stage, the method further comprises:

an initialization stage, during which, controlling the second scanning signal to turn on the initialization circuit, so that the initialization circuit initializes the first node and the light-emitting diode by utilizing an initialization voltage, wherein the capacitor maintains the initialization voltage; and controlling the first scanning signal to turn off the compensation circuit and controlling the first control signal to turn off the driving circuit.

9. The method according to claim 8, wherein the method further comprises:

during the data writing stage, controlling the second scanning signal to turn off the initialization circuit; and during the light-emitting stage, controlling the second scanning signal to turn off the initialization circuit.

10. A display comprising the pixel circuit according to claim 1.

11. The display according to claim 10, wherein the driving transistor and the compensation transistor are mirror transistors.

12. The display according to claim 10, further comprising an initialization circuit, wherein the initialization circuit is located between the first node and the light-emitting diode; and the initialization circuit is externally connected to a second scanning signal and an initialization voltage, and the initialization circuit is configured to initialize the first node and the light-emitting diode by utilizing the initialization voltage, under a control of the second scanning signal.

13. The display according to claim 12, wherein the initialization circuit comprises a first initialization transistor and a second initialization transistor, a first electrode of the first initialization transistor is externally connected to the initialization voltage; a second electrode of the first initialization transistor is electrically connected to the first node; and a gate electrode of the first initialization transistor is electrically connected to the second scanning signal, and a first electrode of the second initialization transistor is externally connected to the initialization voltage; a second electrode of the second initialization transistor is electrically connected to the light-emitting diode; and a gate electrode of the second initialization transistor is electrically connected to the second scanning signal.

14. The display according to claim 10, wherein the driving circuit comprises a driving transistor and a light-emitting control transistor, a first electrode of the driving transistor is externally connected to the external power supply; a gate electrode of the driving transistor is electrically connected to the compensation circuit; and a second electrode of the driving transistor is electrically connected to a first electrode of the light-emitting control transistor, and a second electrode of the light-emitting control transistor is electrically connected to the light-emitting diode, and a gate electrode of the light-emitting control transistor is externally connected to the first control signal.

15. The display according to claim 10, wherein the driving circuit comprises a driving transistor and a light-emitting control transistor, a first electrode of the light-emitting control transistor is externally connected to the external power supply; a second electrode of the light-emitting control transistor is electrically connected to a first electrode of the driving transistor; and a gate electrode of the light-emitting control transistor is externally connected to the first control signal, and a gate electrode of the driving transistor is electrically connected to the compensation circuit; and a second electrode of the driving transistor is electrically connected to the light-emitting diode.

* * * * *